US007707725B2

(12) United States Patent
Eichhorn et al.

(10) Patent No.: US 7,707,725 B2
(45) Date of Patent: May 4, 2010

(54) ELECTRIC SHAVER WITH EXTENDABLE LONGHAIR CUTTER UNIT

(75) Inventors: Reinhold Eichhorn, Idstein (DE); Detlef Gleich, Friedrichsdorf (DE); Peter Junk, Schmitten (DE); Christof Kleemann, Eschborn (DE); Michael Odemer, Niddatal (DE); Thorsten Pohl, Muehlheim (DE); Tobias Schwarz, Schmitten (DE); Thomas Verstege, Frankfurt am Main (DE); Martin Vitt, Frankfurt am Main (DE); Juergen Wolf, Kriftel (DE); Christoph Zegula, Roedermark (DE)

(73) Assignee: Braun GmbH, Kronberg (DE)

( * ) Notice: Subject to any disclaimer, the term of this patent is extended or adjusted under 35 U.S.C. 154(b) by 18 days.

(21) Appl. No.: 12/338,687

(22) Filed: Dec. 18, 2008

(65) Prior Publication Data

US 2009/0133264 A1 May 28, 2009

Related U.S. Application Data

(63) Continuation of application No. PCT/EP2007/004437, filed on May 18, 2007.

(30) Foreign Application Priority Data

Jun. 21, 2006 (DE) ..... 10 2006 028 470

(51) Int. Cl.
*B26B 19/00* (2006.01)

(52) U.S. Cl. ..... 30/34.1

(58) Field of Classification Search ..... 30/34.1
See application file for complete search history.

(56) References Cited

U.S. PATENT DOCUMENTS

| | | | | | |
|---|---|---|---|---|---|
| 3,763,558 | A | * | 10/1973 | Bauerle | 30/34.1 |
| 3,844,035 | A | * | 10/1974 | Bauerle | 30/34.1 |
| 3,909,938 | A | * | 10/1975 | Brenneman et al. | 30/34.1 |
| 3,911,572 | A | * | 10/1975 | Czerner et al. | 30/34.1 |
| 4,380,869 | A | * | 4/1983 | Shirakawa et al. | 30/34.1 |
| 4,408,392 | A | * | 10/1983 | Naimer | 30/34.1 |
| 4,426,776 | A | * | 1/1984 | Kakumoto et al. | 30/34.1 |
| 4,505,036 | A | * | 3/1985 | Ochiai et al. | 30/34.1 |
| 4,509,259 | A | * | 4/1985 | Kakumoto et al. | 30/34.1 |
| 5,022,153 | A | * | 6/1991 | Baron | 30/34.1 |
| 5,052,106 | A | * | 10/1991 | Labrijn | 30/34.1 |

(Continued)

FOREIGN PATENT DOCUMENTS

DE 31 11 871 1/1982

(Continued)

*Primary Examiner*—Jason Daniel Prone
(74) *Attorney, Agent, or Firm*—Jay A Krebs; Leonard W Lewis

(57) ABSTRACT

An electric shaver has a pivotally mounted longhair cutter unit that is pivoted outward into an operating position by motion of an operating switch of the shaver via an actuator that also causes the cutting blades of the longhair cutter unit to extend from the longhair cutter housing. Because the longhair cutter retracts into the longhair cutter housing when the longhair cutter unit is folded shut, the sharp edges of the blades are protected.

20 Claims, 6 Drawing Sheets

U.S. PATENT DOCUMENTS

| | | | | | |
|---|---|---|---|---|---|
| 5,084,967 | A | * | 2/1992 | Nakagawa et al. | 30/34.1 |
| 5,701,673 | A | * | 12/1997 | Ullmann et al. | 30/34.1 |
| 6,381,849 | B2 | * | 5/2002 | Eichhorn et al. | 30/346.51 |
| 6,502,312 | B2 | * | 1/2003 | Beutel et al. | 30/34.1 |
| 6,604,287 | B2 | * | 8/2003 | Melton et al. | 30/34.1 |
| 7,350,300 | B2 | * | 4/2008 | Yamaguchi et al. | 30/34.1 |
| 7,503,117 | B2 | * | 3/2009 | Wetzel et al. | 30/34.1 |
| 2003/0029042 | A1 | * | 2/2003 | Wilcox | 30/34.1 |
| 2003/0106219 | A1 | * | 6/2003 | Lau | 30/34.1 |
| 2003/0126744 | A1 | * | 7/2003 | Lau et al. | 30/34.1 |

FOREIGN PATENT DOCUMENTS

| | | | | |
|---|---|---|---|---|
| DE | 3501045 | A1 | * | 7/1986 |
| DE | 35 09 184 | | | 9/1986 |
| DE | 41 25 213 | | | 2/1992 |
| DE | 41 17 990 | | | 12/1992 |
| DE | 195 21 299 | | | 3/1996 |
| DE | 195 31 013 | | | 10/1996 |
| EP | 398430 | A1 | * | 11/1990 |
| EP | 406974 | A1 | * | 1/1991 |
| FR | 2641489 | A1 | * | 7/1990 |
| JP | 54044968 | A | * | 4/1979 |
| JP | 54115953 | A | * | 9/1979 |
| JP | 54144256 | A | * | 11/1979 |
| JP | 58-32767 | | | 3/1983 |
| JP | 02045085 | A | * | 2/1990 |
| JP | 02071785 | A | * | 3/1990 |
| JP | 02144091 | A | * | 6/1990 |
| JP | 02274280 | A | * | 11/1990 |
| JP | 03032690 | A | * | 2/1991 |
| JP | 04089082 | A | * | 3/1992 |
| JP | 06007554 | A | * | 1/1994 |
| WO | WO2005/002806 | | | 1/2005 |

* cited by examiner

Fig. 6
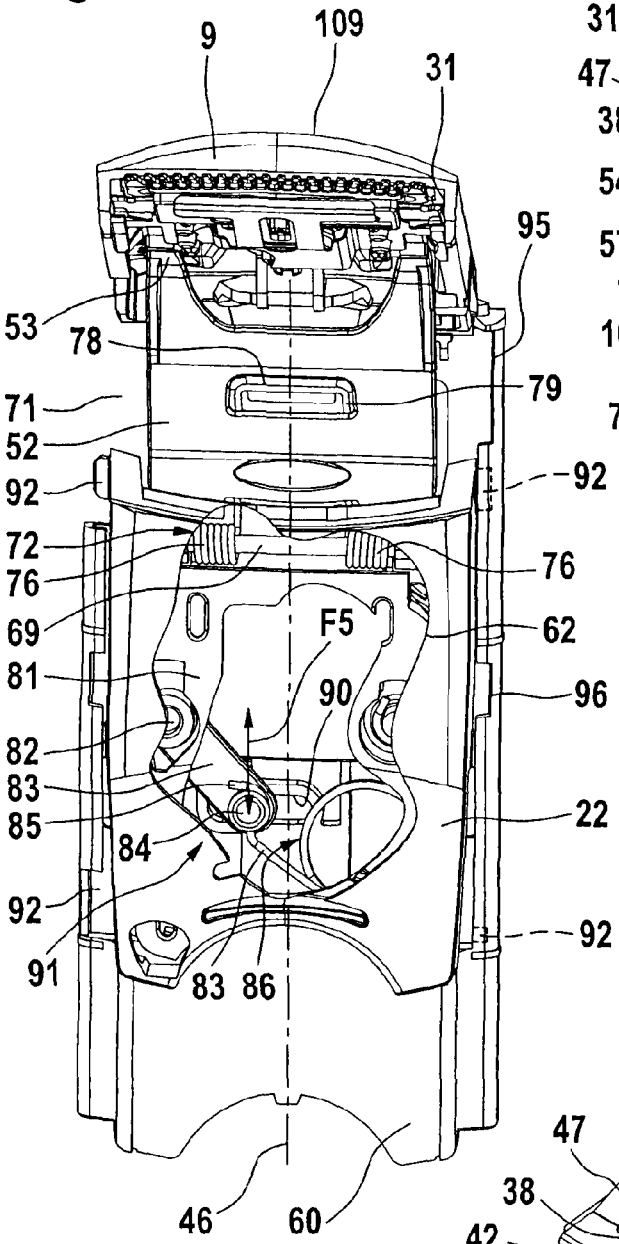
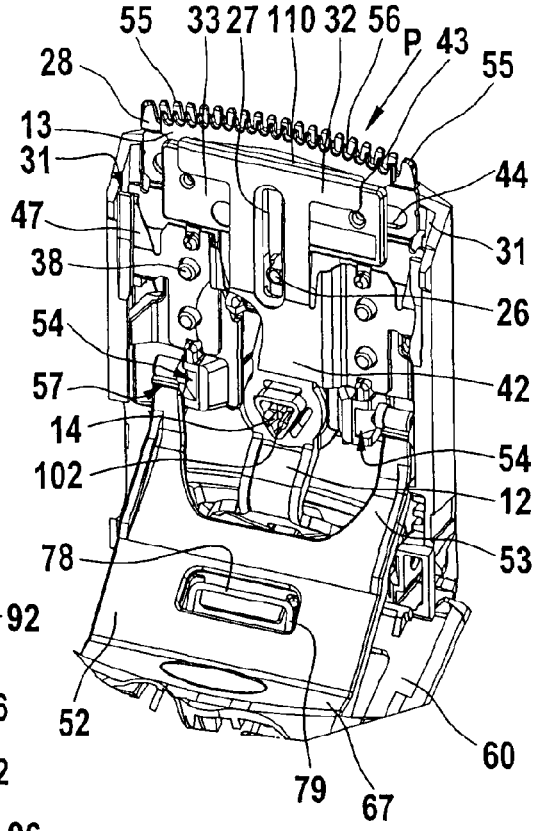
Fig. 7
Fig. 8
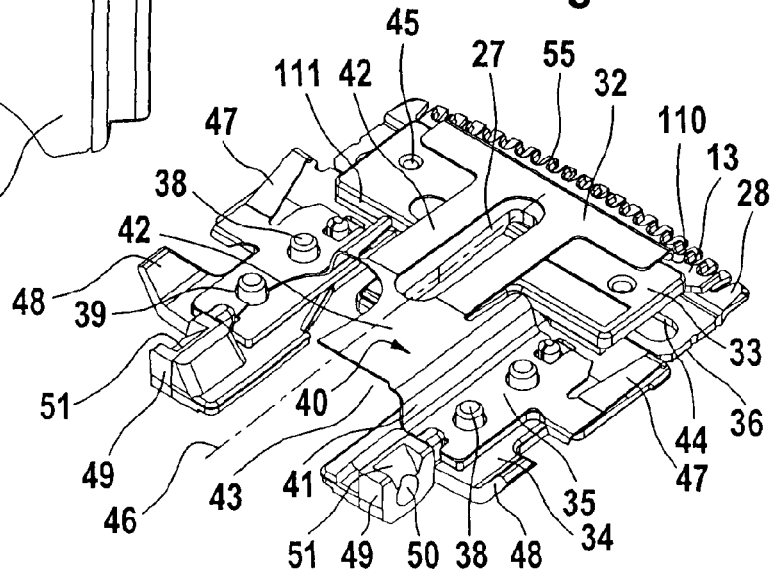

c
15
60
i
66
j
54
57
F2
52
9
60
29
107
99
67
59
68
α
60
h
g
55
x
9
c1
57
66
53
f
58,64
65
28,13
29
98
54
e
15
52
52
l
68
β
59
F3
60
22
F
d
108

ELECTRIC SHAVER WITH EXTENDABLE LONGHAIR CUTTER UNIT

CROSS-REFERENCE TO RELATED APPLICATIONS

This application is a continuation application of and claims priority to PCT Application Serial No. PCT/EP2007/004437, filed on May 18, 2007, through which priority is claimed under 35 U.S.C. §19(a) from German patent application number 10 2006 028 470.4, filed Jun. 21, 2006. The entire contents of PCT Application Serial No. PCT/EP2007/004437 are incorporated herein by reference.

TECHNICAL FIELD

This invention relates to an electrically operated shaver with a longhair cutter unit of the type that is movable into an operable position for cutting long hairs.

BACKGROUND

German patent publication DE 31 11 871 A1 describes an electric shaving apparatus that includes at its top a shorthair cutter unit and on its front a longhair cutter unit. The longhair cutter unit is comprised of an operating switch and a coupled longhair cutter that has at its free end a comb-type lower blade and upper blade which in operation are in sliding relation to each other, thereby shearing off hairs that have entered the combs. In the position of rest, the longhair cutter unit is embedded in a recess formed on the front face of the housing of the shaving apparatus so that the outer contour of the longhair cutter forms a nearly stepless plane with the outside of the housing. To move the longhair cutter unit into its operating position, it is necessary to slide the operating switch upward, whereby the outside of the lower blade slides along a ramp in the housing of the shaving apparatus, swinging obliquely upwardly out of the housing together with the upper blade. As this occurs, a flap closing the longhair cutter exposes the comb-like end to enable it to be moved into contact with an operator's skin surface.

Similarly, Japanese reference JP 58-32767(2) describes an electrically operated shaving apparatus in which a shorthair cutter unit is provided on the upwardly pointing surface and a longhair cutter unit on the front side. Mounted behind a cover plate is a transversely grooved operating switch as well as a barrel-type longhair cutter. On being turned, the longhair cutter is accessible from outside through a square-shaped window. Otherwise, it is turned into the interior of the housing and concealed. Turning of the longhair cutter is effected by an actuator coupled next to the axis of rotation and connected to the operating switch.

German document DE 195 21 299 C1 also describes an electrically operated shaving apparatus that has at its top a shorthair cutter unit and on its front a longhair cutter unit. The longhair cutter unit is activated by an operating switch provided in a recess on the front side. An actuator connected to the operating switch is displaced from bottom to top and in reverse direction in the housing, so that due to the eccentric mounting of the actuator on the longhair cutter the latter is swung about its pivot axis forwardly out of the housing and back into the housing. Detent elements are provided in order for the actuator to lend the longhair cutter unit a stable position in the latter's extended position so that the longhair cutter withstands the shaving forces acting on it during shaving, without folding shut or wobbling. Although in the retracted condition the comb-type cutting plane of the longhair cutter is embedded in the housing recess of the shaver, it is nevertheless visible from outside, and the comb-type sharp edges of the longhair cutter are at least partially exposed.

SUMMARY

According to one aspect of the invention, an electric shaver has a housing carrying a shorthair cutter unit, a longhair cutter unit and an operating switch. The longhair cutter unit is mounted so as to be pivotable with respect to the housing about a pivot axis, between an open position and a closed position. An electric drive is operable to drive the shorthair cutter unit and is mechanically connected to drive the longhair cutter unit in the open position. The longhair cutter unit has a longhair cutter housing carrying a longhair cutter comprised of a lower blade and an upper blade. The longhair cutter unit is connected to the operating switch via an actuator that both pivots the longhair cutter unit toward its open position, and extends the longhair cutter with respect to the longhair cutter housing, in response to a corresponding actuation of the switch.

In some embodiments, the longhair cutter and the actuator are connected via a first rotatable joint, and the actuator is connected to the operating switch via a second rotatable joint. In some configurations, the first joint is disposed outward of the pivot axis with the longhair cutter unit in its closed position. In some arrangements ramps are provided at a free end of the longhair cutter housing as well as at a free end of the actuator, the ramps being configured to slide against one another upon actuation of the actuator, so as to cause a torque that urges the longhair cutter unit toward the open position. In some cases the ramps form an angle with a longitudinal axis of the longhair cutter housing or the actuator which is between 30° and 60°, or about 45°.

In some embodiments the longhair cutter is slidably guided in slide rails extending in the form of grooves provided on the longhair cutter housing.

In some examples the actuating switch is movably mounted on a guide frame that defines opposing guide grooves in which the operating switch is slidably guided on the guide frame. In some cases, the longhair cutter housing is pivotally mounted on the guide frame. In some designs, the guide frame is flange-mounted on the housing of the shaving apparatus such that outer surfaces of both the longhair cutter housing and the operating switch form part of the outer surface of the housing of the shaving apparatus. The actuator may be, for example, a link that is pivotally connected at one end to the longhair cutter through bearing trunnions and is pivotally connected at another end to the guide frame. In some cases the actuator link has angled fork ends.

In some embodiments the operating switch and longhair cutter are guided in straight grooves extending parallel to one another and parallel to a central axis of the longhair cutter unit.

In some cases a distal end of the longhair cutter protrudes beyond a distal end of the longhair cutter housing when the longhair cutter unit is in the open position, whereas with the longhair cutter unit in the closed position the distal end of the longhair cutter is retracted into and concealed by the distal end of the longhair cutter housing. In some shavers, a stop is formed on the longhair cutter housing and on the longhair cutter, against which stop the longhair cutter abuts when the longhair cutter unit is in the open position. In some cases, a stop is formed on the longhair cutter housing and on the guide frame in proximity to the pivot axis, said stop limiting a maximum pivot angle of the longhair cutter housing. Such a stop may be formed by lateral boundary surfaces of the longhair cutter housing and the guide frame that extend obliquely to a central axis of the shaver, for example.

In some examples the shaver has a spring that applies a force that acts upon the actuator in a transverse direction.

In some cases, upon moving the switch to pivot the longhair cutter unit to its open position, the operating switch is acted upon by a force that acts initially in opposition to movement and, after a predetermined length of travel, acts to assist movement of the switch. This force may be provided at least in part, for example, by a leg spring having one end secured directly to the operating switch and another end secured to a lever rotatably mounted on the operating switch, the lever having a distal end that engages a groove extending perpendicularly to a longitudinal axis of the shaver.

Various embodiments described herein feature a longhair cutter that can be swung open easily, while also providing that the front of the shaving apparatus can be closed with the longhair cutter in its rest position.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 6 is a view of the operating switch of the open shorthair cutter unit, as seen looking at right angles to the front in the direction W of FIG. 4, with the operating switch partly broken away.

FIG. 7 is a perspective view of the longhair cutter extended from the longhair cutter housing, as seen looking from the right in the direction V, with the lower part of the guide frame and the operating switch broken away.

FIG. 8 is a perspective front view of the longhair cutter as single part according to FIG. 7, as seen looking obliquely from bottom right.

Like reference symbols in the various drawings indicate like elements.

DETAILED DESCRIPTION

Figure 1:
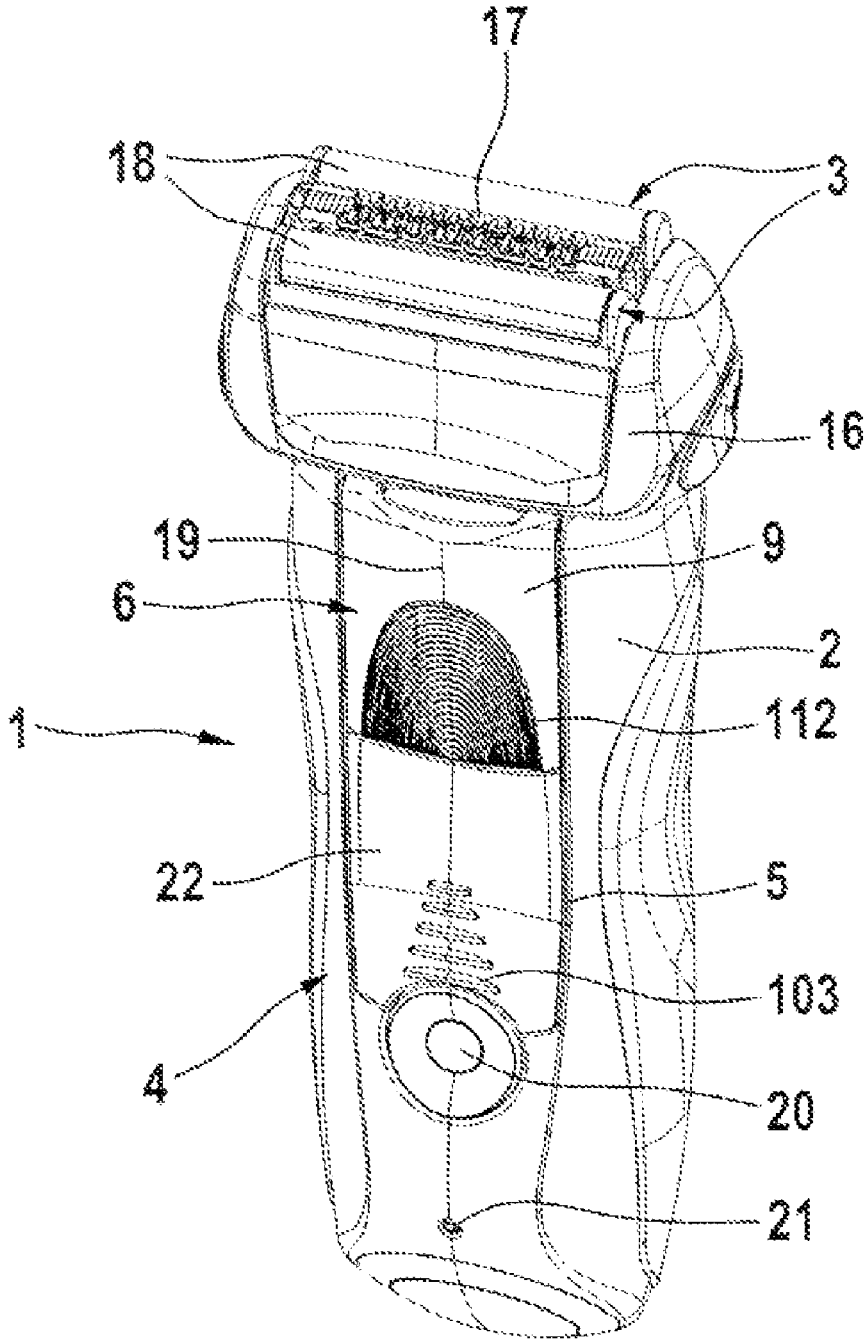
FIG. 1 is a perspective view from top right of an electrically operated shaving apparatus with a longhair cutter unit embedded in the front face.

In FIG. 1 an electrically operable shaving apparatus 1 includes a housing 2 having at its upper end a pivotal shaving head 16 that extends in a direction transverse to a central axis 19 and mounts a shorthair cutter unit 3 with a central cutter 17. The central cutter 17 is arranged between two shaving foils 18 and extends parallel to the foils. The central cutter and the shorthair cutter unit extend perpendicularly to a central axis 46 of the shaving apparatus 1. The perforations of the shaving foils 18 are not shown in FIG. 1 in the interest of simplicity of illustration. Provided underneath the shaving foils 18 and the central cutter 17 are undercutters, not shown in the drawing, which are connected to a drive mechanism of the shaving apparatus 1.

Arranged in the lower part of the front face are an on/off switch 20 and below it a charge indicator 21. A recess 5 provided in the front face 4 of the housing 2 extends from the on/off switch 20 upward to the end of the housing 2. To avoid duplicate description, reference is made to the Braun "Synchro" type shaver which includes a shaving head of the type herein shown and has on its front face an on/off switch and a longhair cutter.

Embedded in recess 5 is a longhair cutter unit 6 that is substantially comprised of a longhair cutter 29 (FIGS. 2 to 11) received in a longhair cutter housing 9, and an operating switch 22 arranged directly below the longhair cutter. The front sides of the longhair cutter housing 9 and the operating switch 22 form part of the front face 4 of the housing 2.

The longhair cutter unit 6 is illustrated as a single part in FIGS. 2 to 11 and on an enlarged scale as compared to FIG. 1. The size of the shaving apparatus 1 shown in FIG. 1 is not its real size either but is illustrated on a reduced scale.

Figure 9:
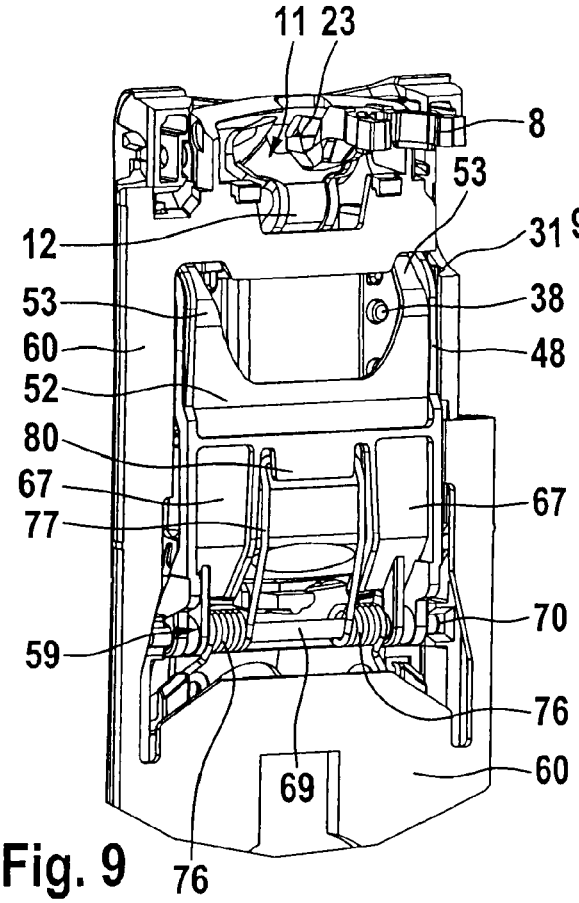
FIG. 9 is a rear view of the longhair cutter unit, as seen looking slightly from the left in the direction T of FIG. 4, with the lower part of the guide frame broken away.
Figure 10:
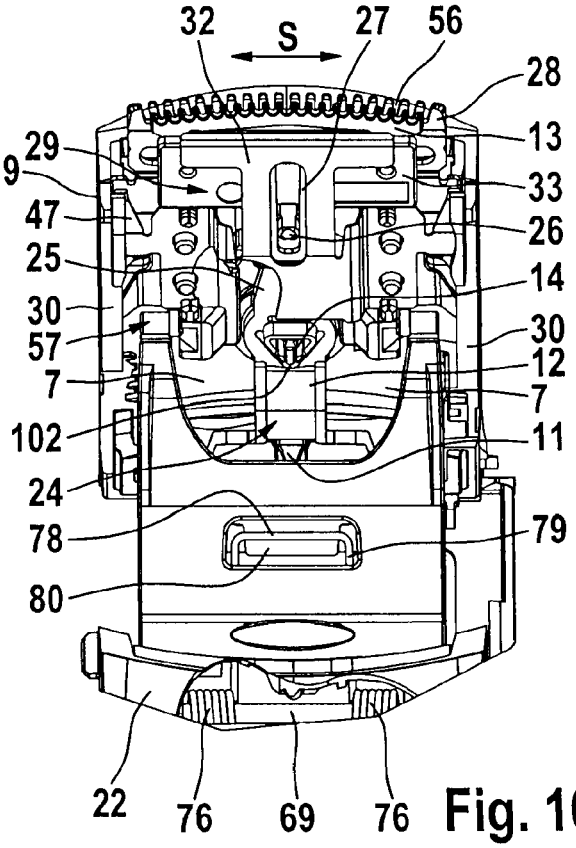
FIG. 10 is a view of the shorthair cutter unit in the direction R of FIG. 4, as seen looking from above in the direction of the longhair cutter housing onto its inner side, in contrast to FIG. 7.

In FIGS. 2 to 11 a driving member 8 is shown at the upper end of the longhair cutter unit 6. The driving member is not part of the longhair cutter unit 6 but is mounted in the housing 2 as a fixed member for establishing the connection to an electrically operated drive mechanism (not shown) of the shaving apparatus 1. The driving member 8 is shown in FIGS. 2 to 11 only for the purpose of illustrating how in FIG. 9 its coupling end 23 engages with a pocket-shaped coupling member 11. The coupling member 11 is part of a lever 24 mounted in an oscillating manner on a trunnion 14 formed on a rear side 7 of the longhair cutter housing 9. The lever 24 is connected to the coupling member 11 via a bar 12, while on the other side of trunnion 14 lever 24 includes an arm 25 (FIG. 11) from which a pin 26 projects and engages in a longitudinal groove 27 provided on a lower blade 13. Because longhair cutter 29 (comprised of upper and lower blades 13, 28) slides upward in grooves 31 formed along edges 30 on the rear side 7 of the longhair cutter housing 9 when the longhair cutter housing 9 of FIGS. 9 and 10 is swung open, pin 26 likewise slides in longitudinal groove 27 from an upper to a lower position due to its fixed mounting on lever 24 and the lever's mounting on trunnion 14.

According to FIG. 8, lower blade 13 is urged against the undersurface of upper blade 28 by a T-shaped spring 32. Fastened to lower blade 13 between the lower blade 13 and spring 32 is a plastic plate 33 that is configured to reduce sliding friction relative to the spring 32 during the oscillating movement of lower blade 13 to thereby obtain a lasting, non-wearing cutter arrangement.

Figure 11:
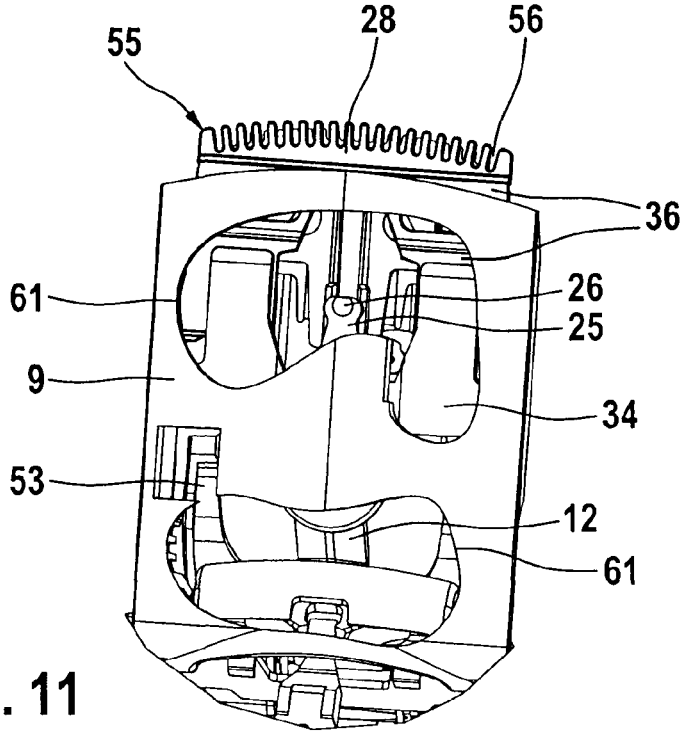
FIG. 11 is a perpendicular view of the broken away outer side of the longhair cutter housing in the direction P of FIG. 7, with the lower portion broken away in the area of transition to the guide frame.

According to FIGS. 7 to 10, spring 32 is in positive engagement with upper blade 28 through opposed cross bars 35. As shown in FIG. 11, two support arms 37 extending from a plastic frame 34 rest against an upper side 36 of upper blade 28 and include anchoring pins 38 that are passed through bores 39 defined in cross bars 35 for engagement behind bores 39. Frame 34 is injection-molded onto both upper blade 28 and spring 32, thereby providing for positive engagement of both parts. Alternatively, frame 34 may also be mounted on spring 32, in which case anchoring pins 38 passing through bores 39 are deformed by a subsequent heat treatment in such a way that they rearwardly embrace the upper side 40 of spring 32 of FIG. 8, thus firmly connecting the two parts with one another.

As shown in FIG. 8, spring 32 includes on cross bars 35 upwardly angled portions 41, so that the central part 42 of spring 32 lies at an elevated level, thereby providing a space 43 for receiving lower blade 13 with its plastic plate 33. The free end of spring 32 is angled towards lower blade 13, forming a stop surface 110 to cause lower blade 13 with its plastic plate 33 of FIGS. 7 and 8 to be bounded in both upward and downward directions by angled portions 41. Angled portions 41 end short of reaching the lower edge 111 of lower blade 13 and plastic plate 33, so that lower blade 13 can protrude laterally. The upper blade 28 includes slots 44 that extend in a direction transverse to central part 42 of spring 32 and are engaged by trunnions 45 extending from plastic plate 33, whereby lower blade 13 is imparted a sliding direction 'S' perpendicular to the longitudinal axis 46 of longhair cutter unit 6. The longitudinal axis 46 extends symmetrically to longhair cutter unit 6 and centrally to the shaving apparatus 1 of FIG. 1.

As shown in FIG. 8, upwardly angled spring elements 47 are provided on the edge of the cross bars 35 of spring 32. Slide cams or slide rails 48 are formed on the frame 34 beneath spring elements 47. Also formed on the frame 34 beneath slide cams 48 are opposed bearing blocks 49 defining bores 50 which extend in a direction perpendicular to longitudinal axis 46. Ramps 51 extending from above toward the outsides of bores 50 serve to elastically expand and subsequently suspend bearing trunnions 54 formed on the actuator 52 at the upper fork ends 53 of FIG. 7 (illustrated in broken lines). In the assembly process, after fork ends 53 are expanded the bearing, trunnions 54 engage bores 50 and are held captive, but allowed to rotate, inside bores 50 after springback of fork ends 53. Because the diameters of bores 50 form a sliding fit with the trunnions, there is little excessive bearing play. The spring 32 is a bent blanked part and is made from a very thin, rustproof leaf spring sheet.

As shown in FIGS. 1 to 13, actuator 52 configured to be in plate shape establishes the connection between longhair cutter 29 and operating switch 22 by being rotatably connected to the longhair cutter via a first joint 57, and to the operating switch via a second joint 59.

At this point it is mentioned that in FIGS. 2, 5, 6 and 11, lines 61, 62 indicate parts of longhair cutter housing 9 and of operating switch 22 that have been broken away to expose the interior parts of shorthair cutter unit 3.

Figure 3:
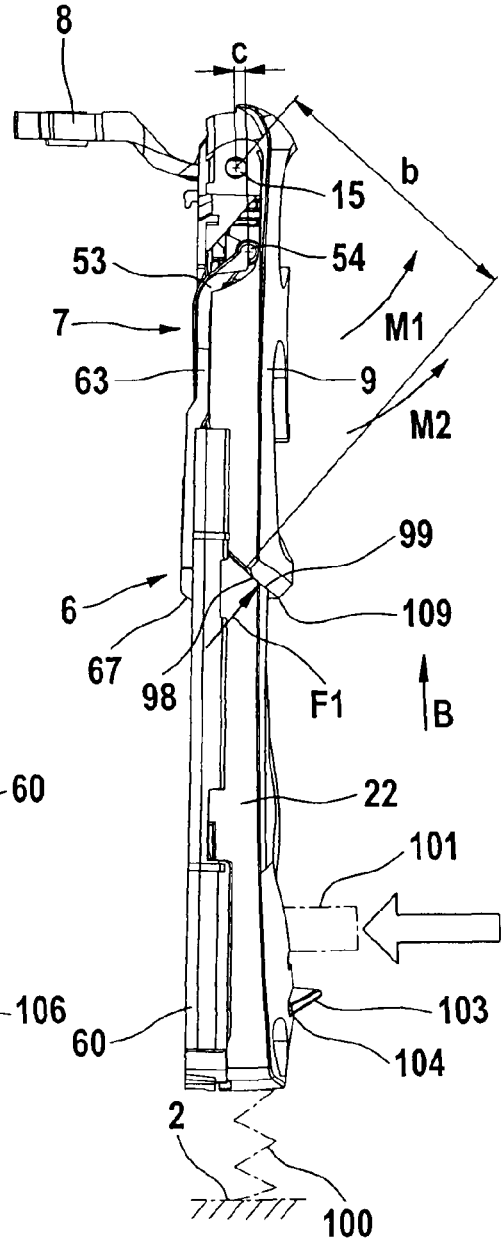
FIG. 3 is a side view of the shorthair cutter unit, as seen looking from the left in the direction X of FIG. 2.
Figure 4:
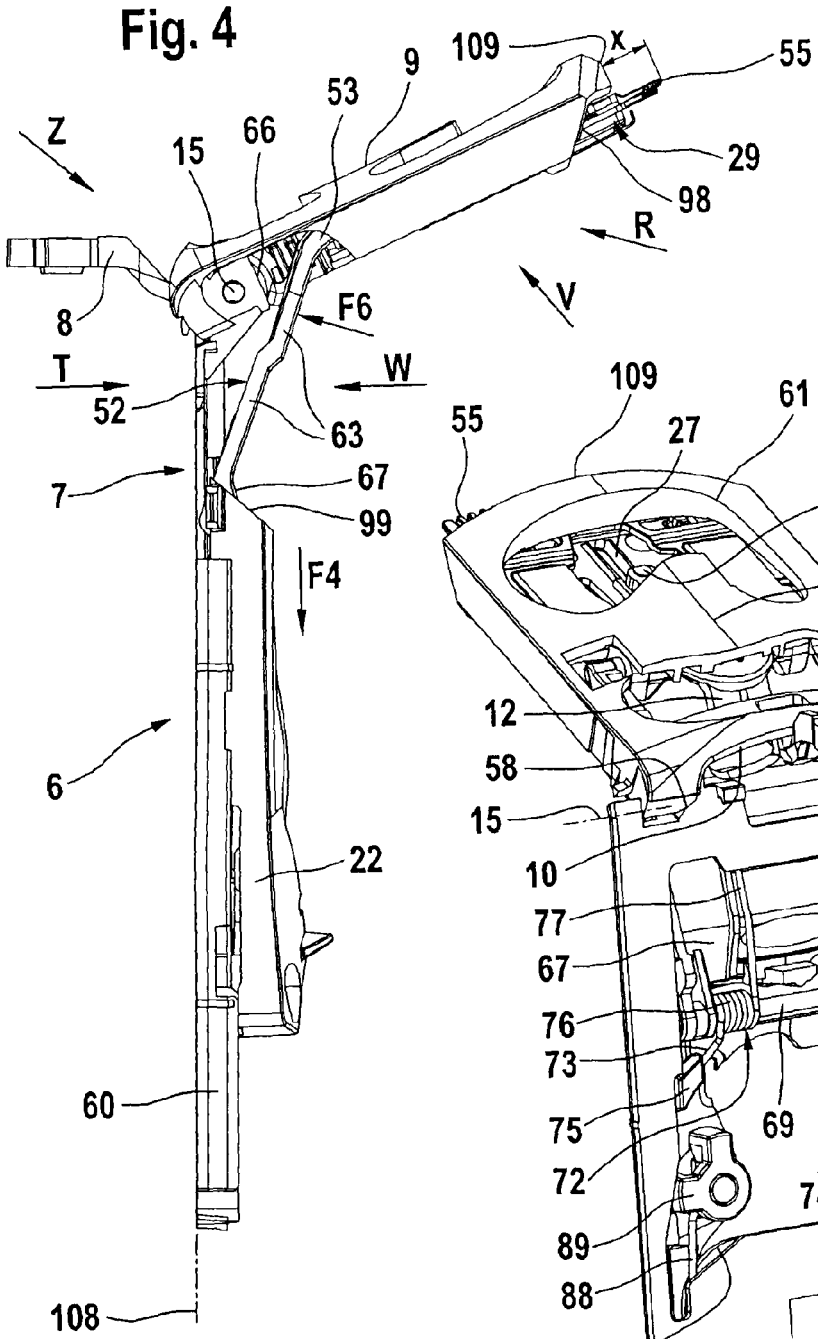
FIG. 4 is a view similar to FIG. 3, but showing the shorthair cutter housing with its shorthair cutter moved into the maximum open position by actuation of the operating switch.

As shown in FIG. 3, fork ends 53 are angled obliquely upwardly toward the longhair cutter housing 9 relative to the central region 63, such that in the maximum swung-open position of the longhair cutter housing 9 these fork ends 53 of actuator 52 extend substantially parallel to the longitudinal extension of longhair cutter housing 9.

Figure 5:
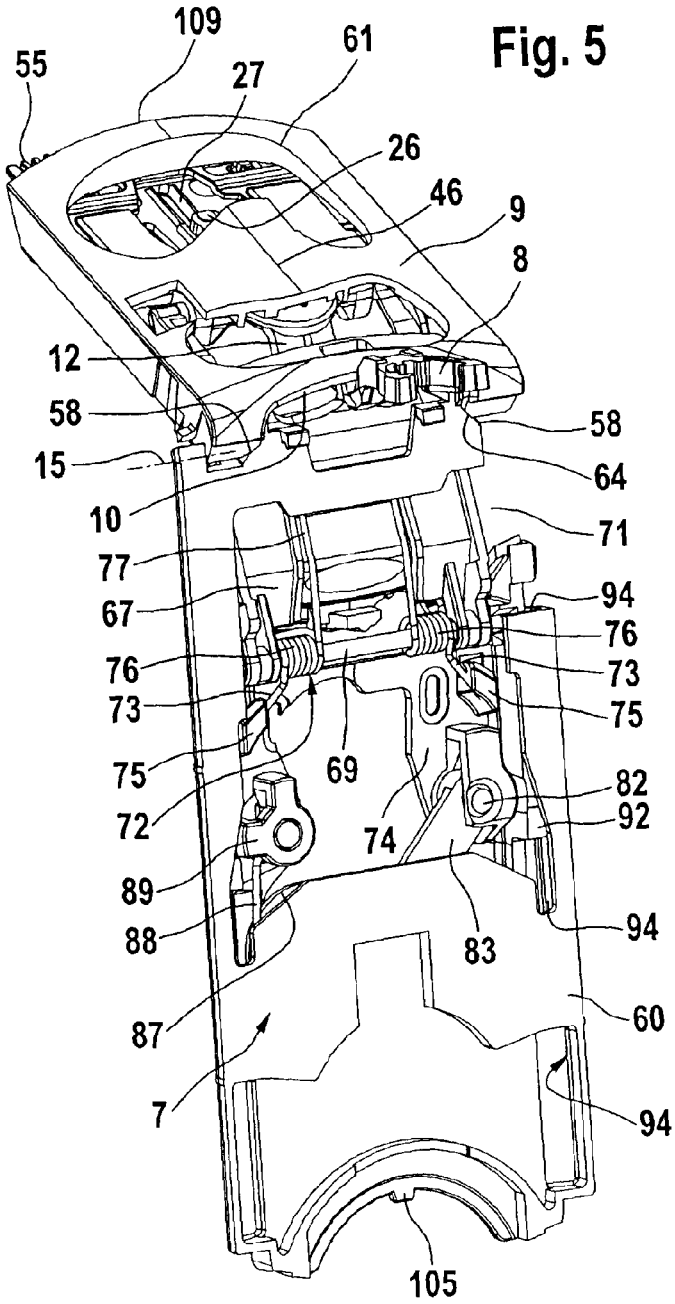
FIG. 5 is a perspective top plan view of the open shorthair cutter unit, as seen looking from top left in the direction of arrow Z of FIG. 4.

As shown in FIG. 5, stop surfaces 58 are formed on a guide frame 60 slightly below pivot axis 15, which stop surfaces extend from the bottom to the top obliquely relative to the central axis 46 and conform with stop surfaces 64 formed on longhair cutter housing 9. In other words, in the maximum open condition stop surfaces 64 on longhair cutter housing 9 abut stop surfaces 58 on guide frame 60, thereby maintaining the maximum pivot angle β of 115°. On the other hand, longhair cutter housing 9 is thereby located centrally on pivot axis 15, avoiding sideways wobbling of longhair cutter housing 9 during shaving. To prevent longhair cutter 29 from extending beyond amount 'X' of FIG. 4, another stop 65 (FIG. 13) is provided on longhair cutter housing 9. To make sure that longhair cutter 29 retracts only a predetermined amount into longhair cutter housing 9 when swung in, an inner stop 66 is provided as shown schematically in FIGS. 12 and 13.

As shown in FIG. 9, actuator 52 extends downward along the center and is equally split into two lower fork ends 67 that define at their ends bores 68 (see FIGS. 12 and 13) extending perpendicularly to longitudinal axis 46 and penetrated by a metal shaft 69 (FIG. 5) that in turn is carried in bearing trunnions 70 formed on operating switch 22 on the rear side. In FIG. 9 part of the upper right edge of the guide frame is broken away to expose the groove 31 into which the slide cams 48 of longhair cutter 29 slidably engage. Similarly, in FIG. 10 part of the guide frame 60 is broken away in the middle on the left side, which is also the case at 71 in FIGS. 5 and 6.

Referring to FIGS. 2, 5, 6 and 11, the shaft 69 mounts a leg spring 72 having two ends 73 each fixedly held clamped on a clamping post 75 projecting from a metal frame 74 (FIG. 5). Starting from the ends 73, spiral-shaped coils 76 are wound around shaft 69, their ends being connected to each other via a U-shaped loop 77. The upper end 78 of loop 77 and/or the leg ends 79 (FIG. 6) rest against a contact surface 80 which is recessed relative to the planar section of actuator 52, and leg spring 72 is biased such that the force exerted on leg ends 79 biases the actuator 52 and hence the longhair cutter 29 of FIG. 4 in the direction of pivot axis 15. This is to make sure that in the swung-in condition of FIG. 3 the longhair cutter housing 9 connected to longhair cutter 29 via slide rail arrangement 31, 48 with zero play is flush with housing 2 of the shaving apparatus of FIG. 1. As such, longhair cutter housing 9 is in such firm abutting engagement with housing 2 that vibrations acting on the shaving apparatus do not cause rattling of longhair cutter unit 6.

Referring to FIG. 5, metal frame 74 is a molded part, preferably injection-molded from metal (aluminum) and having secured to its front face 81 (FIGS. 2 and 6) the operating switch 22 injection-molded from plastic. Here, too, fastening is accomplished by bores (not shown) formed in the metal frame 74, which are penetrated by trunnions (not shown) formed on operating switch 22, with the trunnion ends, which project from the front face 81 of metal frame 74, being deformed by hot deformation so as to lie flush with front face 81.

Figure 2:
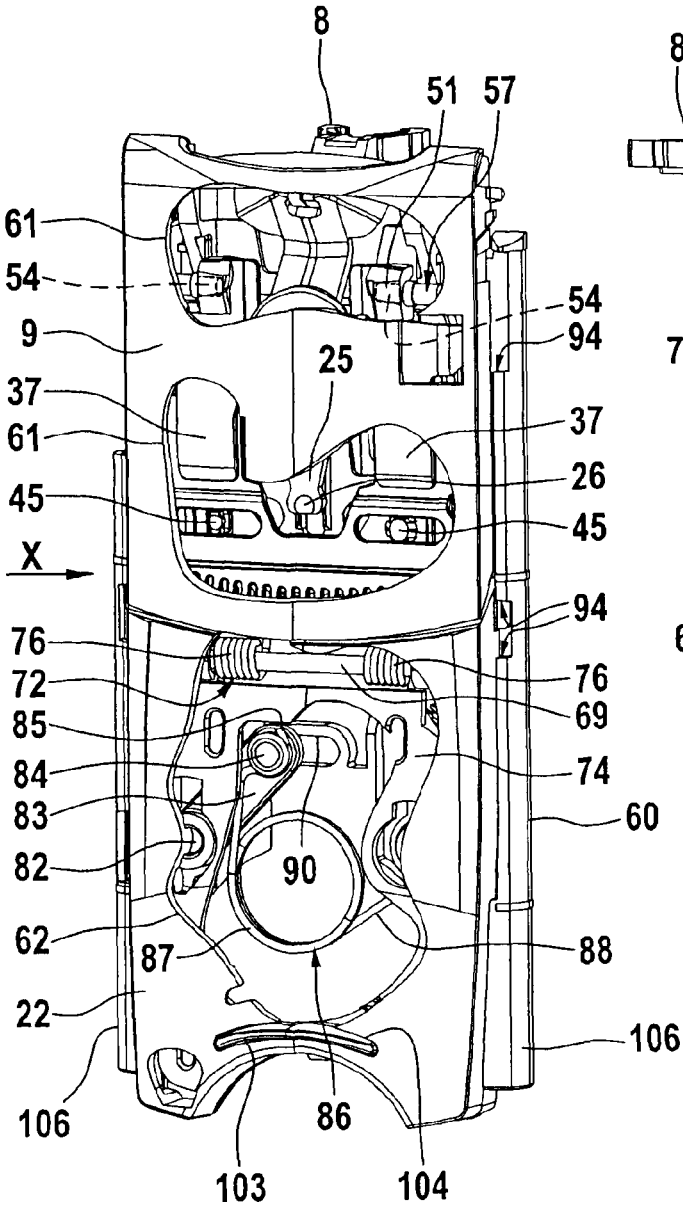
FIG. 2 is a perspective front view of the shorthair cutter unit in closed position, shown enlarged as a single part, with parts of the shorthair cutter housing and the operating switch broken away to expose the interior parts.

Referring to FIG. 6, a bearing trunnion 82 formed on metal frame 74 rotatably mounts a lever 83 injection-molded from plastic and having formed on its other end a bearing trunnion 84 around which the end 85 of a second leg spring 86 is wound with play, such that this end 85 is rotatable about bearing trunnion 84. Referring to FIGS. 2 and 6, spring end 85 continues in a circular wire section 87 that is made up of about 1½ turns and whose exit end 88 extends tangentially, being fixedly held clamped on a bearing block 89 formed on metal frame 74 as shown in FIG. 5. The bearing trunnion 84 formed on lever 83 protrudes also from the other side and engages in a groove 90 formed on guide frame 60 and extending perpendicularly to longitudinal axis 46, such that on displacement of operating switch 22 in an upward or downward direction the bearing trunnion 84 moves sideways back and forth in groove 90.

The biased second leg spring 86 exerts initially a force F5 on operating switch 22, which force acts in opposition to the opening direction but which, as soon as lever 83 adopts a horizontal position, is reversed and urges operating switch 22 upwardly according to FIG. 6. The second leg spring 86 thus cooperates with lever 83 to act as a snap-action spring which exerts on operating switch 22 first a force F5 acting in opposition to the opening direction and, from a certain point on, a force F5 acting in the opening direction. During closing, this snap-action spring arrangement 91 operates correspondingly, i.e., when the operating switch 22 is pushed down, first the spring force F5 has to be overcome and, from a certain point on, a force acting in the closing direction is exerted on operating switch 2.

Referring to FIGS. 2, 5 and 6, slide rails 92 are provided on the edge of operating switch 22 for engagement with grooves 94 that are provided on the edge 93 of guide frame 60 and extend parallel to longitudinal axis 46 of the guide frame. In this manner, operating switch 22 is guided in a straight line and extends parallel to grooves 31 provided on longhair cutter housing 9. For introducing operating switch 22 into the grooves 94, superimposed recesses 95, 96 are formed on said grooves, as shown in FIG. 6. As soon as operating switch 22 is inserted in grooves 94 and connected to actuator 52 via the second joint 59 on the one side and to longhair cutter 29 via the first joint 57 on the other side, operating switch 22 is no longer able to slide out of recesses 95, 96 of grooves 94 because these places are out of the reach of slide rails 92, even on maximum displacement movements of operating switch 22.

In FIG. 6 part of guide frame 60 is omitted on the top left side to expose a slide rail 92. These are otherwise concealed in groove 94 according to FIG. 6 and only shown in broken lines.

Referring to FIG. 3, ramps 98, 99 are formed at the free ends of operating switch 22 and longhair cutter housing 9 lying opposite when in the closed position. In lieu of the second leg spring 86 it is also possible to provide a compression spring 100 on guide frame 60 or on housing 2, which urges operating switch 22 upwardly according to FIG. 3 and does not move it until, for example, an inhibiting member 101 inhibiting displacement of operating switch 22 is unlocked. This possible variant is only shown in broken lines in FIG. 3. It will be understood, of course, that other spring variants are possible to enable operating switch 22 to be displaced after unlocking.

Referring to FIGS. 1 to 3, superimposed ribs 103 extending in a direction transverse to central axis 19 are arranged on the upper side of operating switch 22, which ribs penetrate upwardly through apertures 104 defined in operating switch 22 and are integrally formed on metal frame 74. Integrally formed on the front face of longhair cutter housing 9 injection-molded from plastic are thin ribs 112 which extend elliptically and are intended to represent a clear separation of the longhair cutter housing from operating switch 22.

The guide frame 60 is provided with fastening devices 105, 106 which enable longhair cutter unit 6 to be held in recess 5 of the shaving apparatus with positional accuracy.

The mode of operation of shorthair cutter unit 3 is as follows:

To activate longhair cutter unit 6, first the operating switch 22 of FIGS. 1 to 3 is moved upward in the direction B. Already after a few tenths of a millimeter, the ramp 99 formed in operating switch 22 abuts the ramp 98 formed on longhair cutter housing 9, and with the sliding motion continuing a torque M1 is produced from the force F1 resulting from the actuating force F acting on the ramps and the lever arm 'b', which torque enables longhair cutter housing 9 to be swung about pivot axis 15. After bearing play on the joints 57, 59 is overcome, the force of the sliding motion on operating switch 22 causes a force F2 to act on bearing trunnion 54 that is transmitted via the second joint 59 and from there via actuator 52 to the first joint 57, so that, due to the resulting lever arm 'c' between the center point of first joint 57 and the center point of pivot axis 15, a torque M2 is produced that is initially additive to torque M2. In this manner, the force required to swing out the longhair cutter housing 9 with its integrated longhair cutter 29 is initially extremely low.

While the spring force applied by second leg spring 86 acts in opposition to the displacement force of operating switch 22, the spring forces are nevertheless designed to keep the energy required to move operating switch 22 at a low level. The more longhair cutter housing 9 is swung open, the longer the lever arm 'c' and the higher the torque M2. Because of the absence of contact between ramps 98 and 99, torque M1 drops to zero after just a few millimeters of displacement travel 'd' of operating switch 22.

Although torque M2 increases as a result of 'c' increasing to c1, the displacement force F on operating switch 22 does not increase because the force acting in opposition to operating switch 22 increases due to the increasing biasing force of the second leg spring. Advantageously, the mechanism is well balanced such that the displacement force F remains nearly constant in spite of the increase in torque M2 and the increase in the counteracting force F3 applied by second leg spring 86. The longhair cutter 29 is held against stop 66 in longhair cutter housing 9 by the first leg spring 72.

As soon as lever 83 reaches its approximately horizontal position as shown in FIG. 6, i.e., it extends perpendicularly to longitudinal axis 46, the force of the second leg spring acts upwardly according to FIG. 6, thereby turning lever 83 about bearing trunnion 82 in a counterclockwise direction. Due to the sliding engagement of bearing trunnion 84 with groove 90 provided on operating switch 22, the operating switch is swung upwardly without the application of any external force. Because of the fixed coupling of actuator 52, the longhair cutter 29 is moved outwardly relative to longhair cutter housing 9 in grooves 31 until its abutting engagement with the next stop 65. This is possible because the force of leg spring 72 is now lower than the force of second leg spring 86.

During the swinging-up movement, the coupling end 23 provided on coupling member 8 engages into the pocket-shaped coupling member 11 of lever 24, and lever 24 is caused to move in alternating directions by the reciprocating coupling end 23. Because the lever 24 is rotatably mounted on trunnion 14 through its bore 102, the other end carrying pin 26 moves in just the opposite direction. As a result of the engagement of pin 26 with longitudinal groove 27, the lower blade 13 is reciprocated in the direction 's', closing and opening the slots 56 formed on upper blade 28, so that hairs entering the slots 56 are sheared off between lower blade 13 and upper blade 28.

Figures 12, 13:
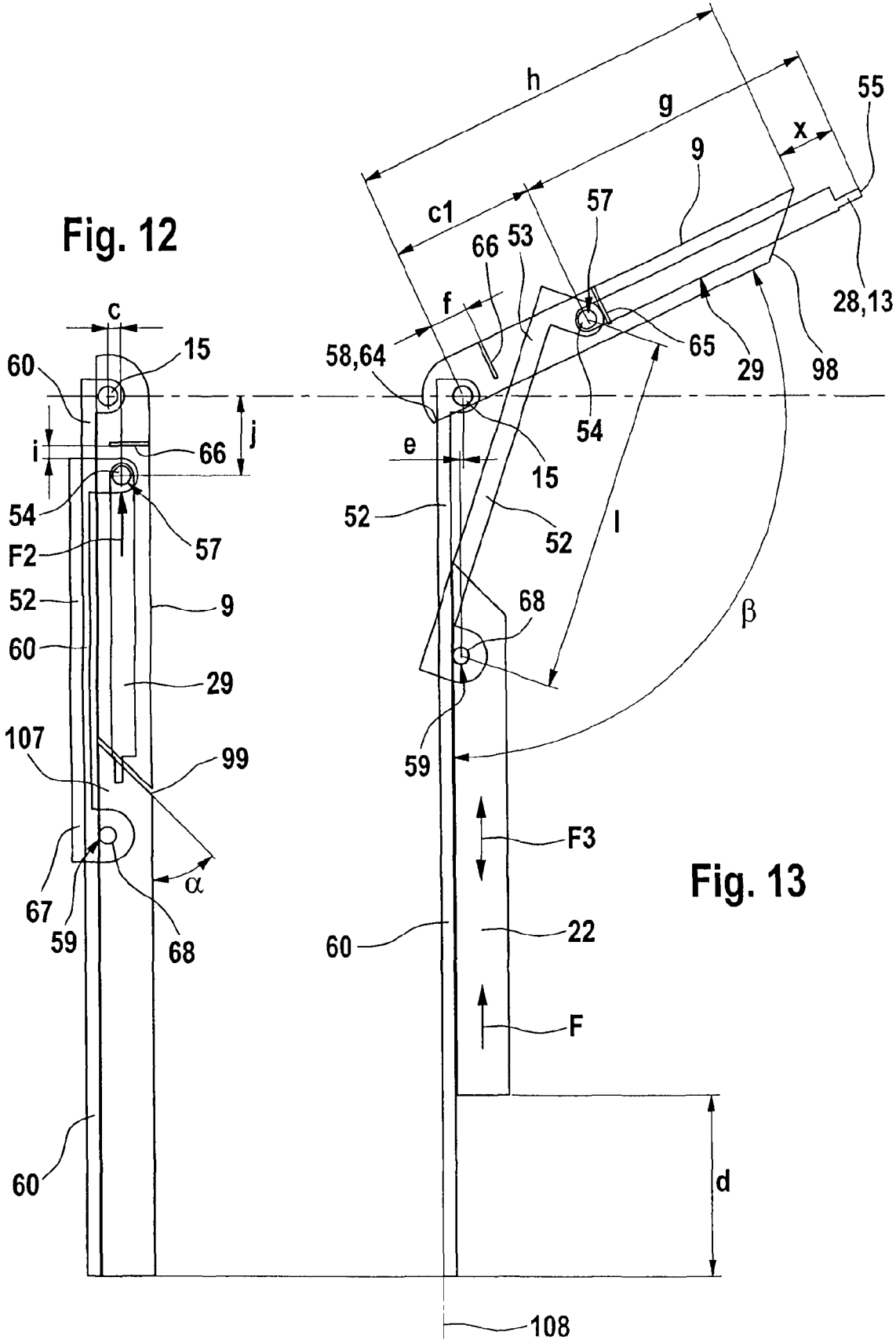
FIG. 12 is a schematic side view of the closed longhair cutter unit of FIG. 3.
FIG. 13 is a schematic side view of the open longhair cutter unit of FIG. 4.

Closing of the longhair cutter unit 6 takes place precisely in inverted order. To return longhair cutter housing 9 with longhair cutter 29 from its maximum open position back to its closed position, operating switch 22 of FIG. 1 is moved downwards. This requires a force F4 to be applied that acts in opposition to the force F5 of second leg spring 86. In the initial phase of the return movement, longhair cutter 29 moves in grooves 31 provided on edge 30 in the direction of pivot axis 15. The angled fork ends cause a displacement force to be produced in the direction of grooves 31 that effects retraction of longhair cutter 29. At the same time, longhair cutter housing 9 is swung inward about pivot axis 15 by longhair cutter 29. As soon as lever 83 reaches its horizontal position, which is approximately perpendicular to longitudinal axis 46, the force of leg spring 86 acts in opposition to the force F5 (FIG. 6), automatically moving operating switch 22 downward into its home position as shown in FIG. 2. As this occurs, actuator 52 pulls longhair cutter 29 inwardly into longhair cutter housing 9 until abutment with stop 66 (FIG. 13). The longhair cutter housing then swings about pivot axis 15 until the closed position shown in FIGS. 2 and 3 is reached. The closing action of longhair cutter housing 9 is further assisted by the fact that force F6 acts on actuator 52 and holds it in the closed position when longhair cutter housing 9 is closed.

In the example illustrated in FIGS. 12 and 13, the length 'l' between the first and second joints 57 and 59 is 27 mm, dimension 'c' is 1 mm, dimension c1 is 12.3 mm, dimension 'd', which is the maximum actuating travel, is 13.5 mm, distance 'e' between the center point of pivot axis 15 and the center point of second joint 59 in the maximum swung-open condition of shorthair cutter housing 9 is 0.3 mm, distance 'f' between pivot axis 15 and stop 66 is 3 mm, distance 'g' between the center point of first joint 57 and the free end 55 of longhair cutter 29 is 23 mm, the ramp angle $\alpha$ is 45°, distance 'h' between the foremost point of longhair cutter housing 9 and the center point of pivot axis 15 is 59 mm, and distance 'i' between stop 66 and the upper side of actuator 52 is 0.3 mm.

As shown in FIGS. 12 and 3, longhair cutter 29 fits snugly within the space 107 formed between fork ends 53 and 67. The free ends 55 of upper and lower blades 28 and 13 are of a comb-shaped configuration, such that hairs entering the slots are cut off on a sideways movement in the direction 's' of lower blade 13 relative to upper blade 28.

Because the longhair cutter is movably mounted in the longhair cutter housing and the actuator is directly coupled to the longhair cutter, the longhair cutter pops up a small amount out of the longhair cutter housing when the latter swings open, so that the comb-type end of the longhair cutter is easily accessible from outside for cutting hair. When the longhair cutter housing is swung back, the actuator retracts the longhair cutter back into the longhair cutter housing until its comb-type end is concealed by the longhair cutter housing and no longer visible from outside.

Because the longhair cutter is completely retracted into the interior of the longhair cutter housing, the shaver is imparted a uniformly closed outer contour which is due to the fact that the longhair cutter housing is able to lie flush with the shaver housing. Dust and other contaminants are thereby prevented from entering the housing interior. Accordingly, the longhair cutter housing serves as a receptacle and mount for the longhair cutter itself on the one hand and, on the other hand, as a protective shield and dust guard in the retracted condition.

The longhair cutter unit is configured to swing out of, and back into, the housing of the shaving apparatus with particular ease. The above-described features enable a particularly low-friction flip-up mechanism in which in the open condition of the longhair cutter the actuator is free to pivot outwards at the free end of the operating switch.

The longhair cutter unit may be opened solely by actuation of the operating switch. The farther the joint between actuator and longhair cutter housing is disposed outward of the pivot point, the greater the ease with which the longhair cutter unit can be opened. However, increasing this dimension can lead to a broader dimension of the shaving apparatus when the longhair cutter unit is to rest flush with the housing. Preferably, this offset distance is small, allowing the longhair cutter unit to be built to the narrowest possible width. By providing ramps at the free ends of the longhair cutter housing and the operating switch, which rest snugly against each other with the longhair cutter housing closed, the lever force necessary on the operating switch for opening the longhair cutter unit is kept at an extremely low level. The ramps, which extend from the front surface of the operating switch obliquely upwardly towards its rear surface as seen looking at the operating switch from the side and with the longhair cutter unit closed, form a ramp angle preferably of 45°. On axial displacement of the operating switch along the ramp of the longhair cutter housing, a counterclockwise acting torque develops. The initial force results from the force applied by an operator's hand to the operating switch. Only later does a force act on the bearing trunnion of the longhair cutter housing, because first a defined bearing clearance has to be used up on the joints of the actuator.

The longhair cutter is movably guided toward and away from the pivot axis in slide rails formed on the longhair cutter housing. In lieu of slide rails it is also possible to select a dovetail guide or some other linear rail guide, such that the longhair cutter is slidably guided on the longhair cutter housing at right angles away from and towards the pivot axis.

The operating switch is also longitudinally guided in slide rails, with the slide rails extending likewise perpendicularly to the pivot axis and lengthwise of the shaver's central axis. With the longhair cutter unit in closed position, the slide rails extend on the longhair cutter housing and on the guide frame for the operating switch substantially parallel and are superimposed. The axes of the first and second joints as well as the pivot axis extend parallel to each other and perpendicularly to the slide rail arrangements, in order to enable a smooth movement of the operating switch and the longhair cutter.

In the open position the comb end of the longhair cutter projects a predetermined amount 'x' from the free end of the longhair cutter housing. Given a distance 'a' of 0.6 mm between the pivot axis and the first joint, a length 'l' of 27 mm between the first and second joint on the actuator, and a pivot angle $\beta$ of 115° for the longhair cutter housing, a dimension 'x' of 0.5 mm, approximately, is obtained. In this case, the operating switch has been moved upwardly by a distance 'd' of 6 mm. In the home position of the longhair cutter housing, that is, at an angle $\beta$ of 0°, the longhair cutter is retracted inside the longhair cutter housing to an extent causing dimension 'x' to be smaller than zero, i.e., proceeding in the opposite direction.

A first stop is formed on the longhair cutter housing, which stop is configured to conform to a stop on the longhair cutter such that, when the longhair cutter housing has been moved through angle $\beta$ to the outer extreme of its outward travel, the first stop abuts the longhair cutter so that the latter can no longer be displaced outwardly in its guide groove and is thereby held in this maximum advanced position by the force of a snap-action spring.

A second stop for limiting the pivotal movement of the longhair cutter housing is formed in close proximity to the pivot axis, so that the maximum pivot angle $\beta$ of the longhair cutter housing is accurately maintained. The first and the second stop help to produce a flip-up mechanism which is particularly resistant to bending and wobble-free and ensures that the longhair cutter, in swung-out condition during a shaving operation, always maintains its end position relative to the housing of the shaving apparatus. This enhances the shaving action because the cutters can be guided along the skin surface with great accuracy.

Lateral boundary surfaces extending obliquely to the pivot axis are formed on the longhair cutter housing and the guide frame in order to make sure that in the outer extreme of its outward travel the longhair cutter housing is held locked against sideways movement, being centered on the pivot axis with zero play, in order to thereby lend the longhair cutter a stable, zero-play position also at this point during a shaving operation.

The illustrated longhair cutter unit is a self-contained unit that only needs to be adapted to the housing of a shaving apparatus. The preassembly of the longhair cutter unit inclusive of the operating switch arranged on the guide frame thus can take place prior to the final assembly on the housing. Accordingly, a function test can also be performed prior to assembly with the housing, so that only properly functioning longhair cutter units are mounted on the housing of the shaving apparatus.

The actuator is preferably of a substantially plate-shaped configuration, forming at either end each two fork-shaped arms on which the first and the second joint are provided. As a result of the widely spaced apart fork ends, particularly sturdy joints resisting transverse forces are obtained which are carried in axles or bores of the longhair cutter and actuator. In lieu of bores formed in the joints for engagement by the axles configured as trunnions or as shafts, a possible alternative is to provide trunnions which engage in bores on the longhair cutter and the actuator. If trunnions are provided on the fork ends, during assembly each fork end is expanded until the trunnions resiliently engage the bores provided on the longhair cutter and the actuator, subsequently remaining permanently in the sprung-back position. In the illustrated embodiment, the metallic longhair cutter has plastic arms formed on it which include bores on the sides for engagement with axles provided on the fork ends of the actuator. The fork ends at the other end of the actuator define bores through which a metal axle clipped onto the operating switch extends. A receptacle is formed between the angled fork ends for seating engagement with the longhair cutter when the longhair cutter unit is folded shut. In this manner, the width dimension of the longhair cutter unit can be kept particularly narrow.

A restoring force acting on the actuator in the direction of the pivot axis prevents rattling noise in the unit. At the same time, the restoring force acts to move the longhair cutter back into its initial position when the longhair cutter housing is swung in. The spring is preferably a flexed wire spring which is spirally wound about the axle on the second joint and bears with one end against the operating switch and with its other end against the actuator for producing the restoring force.

The force of a snap-action spring arrangement acts on the operating switch, as a result of which a spring force acts in opposition to the movement of the operating switch up to about half the actuating travel, the spring force acting in the direction of movement of the operating switch after this half of the actuating travel is overcome. As a result, the actuator is moved, and with it the longhair cutter, to its maximum open position. The illustrated snap-action spring arrangement includes a leg spring having its one end secured directly to the operating switch and its other end to a lever rotatably mounted on the operating switch, with the free end of the lever being pivotally secured to the switch housing. The two legs are connected to each other by a spiral spring coil which, on actuation of the operating switch between its fixed points on the housing and on the lever, experiences a displacement relative to the operating switch.

While a number of examples have been described for illustration purposes, the foregoing description is not intended to limit the scope of the invention, which is defined by the scope of the appended claims. There are and will be other examples and modifications within the scope of the following claims.

What is claimed is:

1. An electric shaver comprising:

a housing carrying a shorthair cutter unit, a longhair cutter unit and an operating switch, the longhair cutter unit mounted so as to be pivotable with respect to the housing about a pivot axis between an open position and a closed position;

an electric drive disposed within the housing and operable to drive the shorthair cutter unit and mechanically connected to drive the longhair cutter unit in at least the open position;

the longhair cutter unit including a longhair cutter housing carrying a longhair cutter comprised of a lower blade and an upper blade, the longhair cutter having comb ends that form a cutting plane of the longhair cutter;

wherein the longhair cutter unit is connected to the operating switch via an actuator that both pivots the longhair cutter unit toward its open position, and extends the longhair cutter with respect to the longhair cutter housing, in response to a corresponding actuation of the switch.

2. The shaver of claim 1, wherein the longhair cutter and the actuator are connected via a first rotatable joint.

3. The shaver of claim 2, wherein the actuator is connected to the operating switch via a second rotatable joint.

4. The shaver of claim 2, wherein in the closed position of the longhair cutter unit the first joint is disposed outward of the pivot axis.

5. The shaver of claim 4, wherein ramps are provided at an end of the longhair cutter housing as well as at an end of the operating switch, the ramps configured to slide against one another upon actuation of the actuator, so as to cause a torque that urges the longhair cutter unit toward the open position.

6. The shaver of claim 5, wherein the ramps form an angle with a longitudinal axis of the longhair cutter housing or the actuator which is between 30° and 60°.

7. The shaver of claim 1, wherein the longhair cutter is slidably guided in slide rails extending as grooves provided on the longhair cutter housing.

8. The shaver of claim 1, wherein the actuating switch is movably mounted on a guide frame that defines opposing guide grooves in which the operating switch is slidably guided on the guide frame.

9. The shaver of claim 8, wherein the longhair cutter housing is pivotally mounted on the guide frame.

10. The shaver of claim 9, wherein the guide frame is flange-mounted on the housing of the shaver such that outer surfaces of both the longhair cutter housing and the operating switch form part of the outer surface of the housing of the shaver.

11. The shaver of claim 9, wherein the actuator comprises a link that is pivotally connected at one end to the longhair cutter through bearing trunnions and is pivotally connected at another end to the guide frame.

12. The shaver of claim 11, wherein the link has angled fork ends.

13. The shaver of claim 1, wherein the operating switch and longhair cutter are guided in straight grooves extending parallel to one another and parallel to a central axis of the longhair cutter unit.

14. The shaver of claim 1, wherein a distal end of the longhair cutter protrudes beyond a distal end of the longhair cutter housing when the longhair cutter unit is in the open position, whereas with the longhair cutter unit in the closed position the distal end of the longhair cutter is retracted into and concealed by the distal end of the longhair cutter housing.

15. The shaver of claim 14, wherein stops are formed on the longhair cutter housing and on the longhair cutter, the longhair cutter abuts against said stops when the longhair cutter unit is in the open position.

16. The shaver of claim 14, wherein stops are formed on the longhair cutter housing and on a guide frame in proximity to the pivot axis, said stops limiting a maximum pivot angle of the longhair cutter housing.

17. The shaver of claim 16, wherein the stops are formed by lateral boundary surfaces of the longhair cutter housing and the guide frame that extend obliquely to a central axis of the shaver.

18. The shaver of claim 1, further comprising a spring that applies a force that acts upon the actuator in a transverse direction.

19. The shaver of claim 1, wherein upon moving the switch to pivot the longhair cutter unit to its open position, the operating switch is acted upon by a force that acts initially in opposition to movement and, after a predetermined length of travel, acts to assist movement of the switch.

20. The shaver of claim 19, wherein the force is provided at least in part by a leg spring having one end secured directly to the operating switch and another end secured to a lever rotatably mounted on the operating switch, the lever having a distal end that engages a groove extending perpendicularly to a longitudinal axis of the shaver.

* * * * *